US005294204A

United States Patent [19]

Clary

[11] Patent Number: 5,294,204

[45] Date of Patent: Mar. 15, 1994

[54] MULTI-LINE PRINTER FOR SLIPS OR THE LIKE

[76] Inventor: John G. Clary, 2850 Thorndike Rd., Pasadena, Calif. 91107

[21] Appl. No.: 993,354

[22] Filed: Dec. 18, 1992

[51] Int. Cl.[5] ..... B41J 13/03

[52] U.S. Cl. ..... 400/636; 400/636.1; 400/636.2

[58] Field of Search ..... 400/605, 636, 636.1, 400/636.2, 636.3, 637, 637.1, 637.2, 637.3, 584

[56] References Cited

U.S. PATENT DOCUMENTS

| | | | |
|---|---|---|---|
| 4,589,784 | 5/1986 | Valle et al. | 400/56 |
| 4,671,441 | 6/1987 | Hauslaib | 400/605 |
| 4,834,277 | 5/1989 | Gomoll et al. | 400/605 |
| 4,848,944 | 7/1989 | Fuller et al. | 400/629 |
| 4,944,620 | 7/1990 | Scozzadava et al. | 400/607 |
| 4,992,805 | 2/1991 | Yoshizawa et al. | 400/605 |
| 5,061,095 | 10/1991 | Asai et al. | 400/636 |
| 5,080,513 | 1/1992 | Clary | 400/605 |
| 5,139,353 | 8/1992 | Ota | 400/584 |

*Primary Examiner*—Edgar S. Burr
*Assistant Examiner*—John S. Hilten
*Attorney, Agent, or Firm*—Fred N. Schwend

[57] ABSTRACT

A data printer wherein a slip is dropped in a guide chute and a serially operable print head is moved along the length of the slip to print a line of characters. A line feed device comprises a drive gear meshing with a driven gear carrying a feed roller for frictionally advancing the slip from one print line position, extending parallel to the length of the slip, to the next. The driven gear is moveable about the axis of the drive gear and is forced into frictional engagement with the slip by the rotational force imparted to the driven gear by the drive gear.

1 Claim, 1 Drawing Sheet

FIG. 4
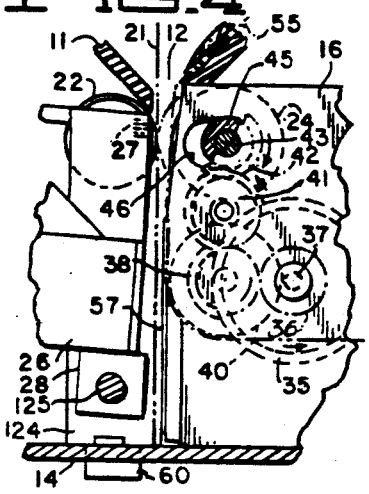
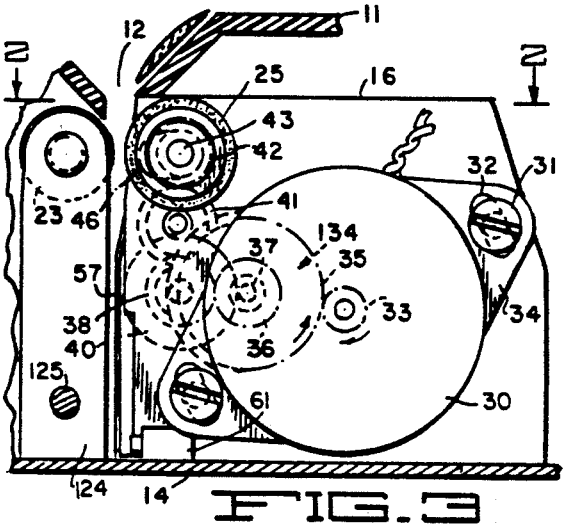
FIG. 3
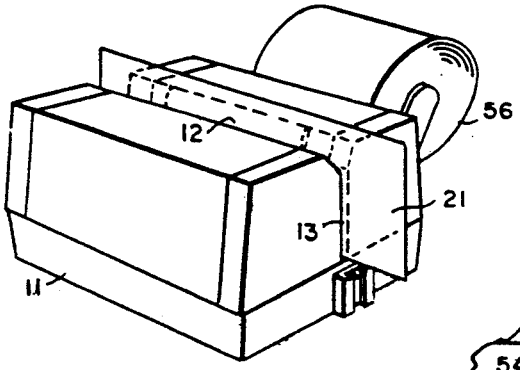
FIG. 1
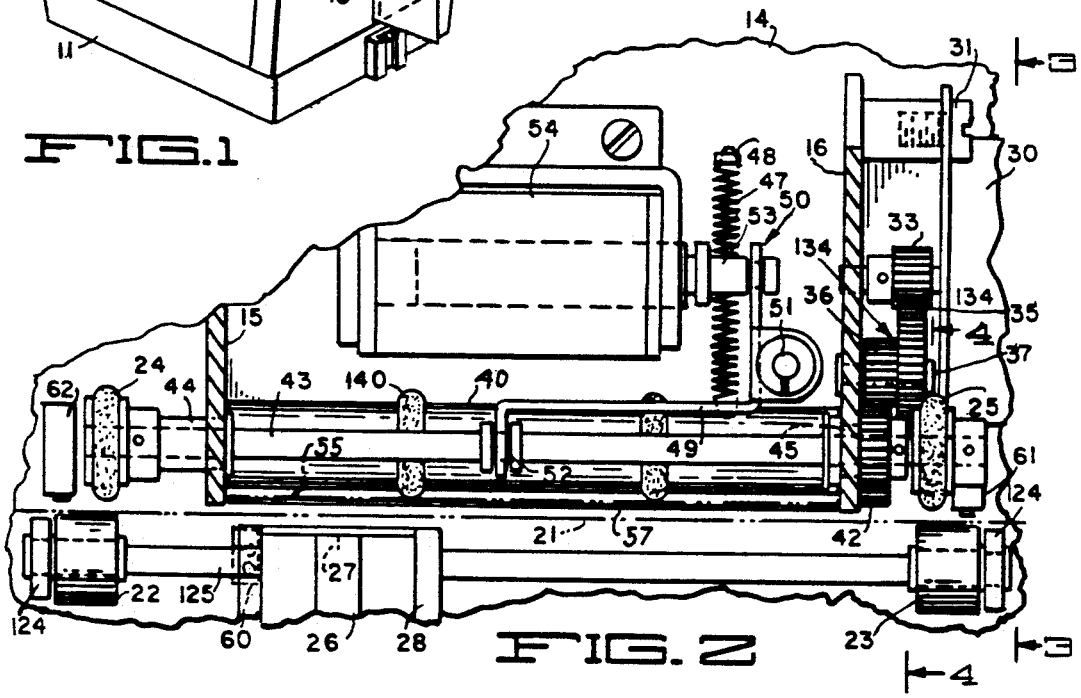
FIG. 2

MULTI-LINE PRINTER FOR SLIPS OR THE LIKE

BACKGROUND OF THE INVENTION

I. Field of the Invention

This invention relates to data printers and has particular reference to a printer for printing a plurality of lines of print lengthwise on slips or forms.

II. Description of the Prior Art

In many business applications, records are made of transactions on slips which are given to a customer as a record of such transactions. For example, in banking transactions such a printed slip may be given to a depositor as a record of his deposit.

The U.S. Pat. Nos. 4,944,620, issued on Jul. 31, 1990 and 5,080,513, issued on Jan. 14, 1992, disclose and claim slip printers, each utilizing a serial printer head, preferably of the inkjet type. When a slip is dropped into a receiving chute, the print head is moved along the length of the slip to print a line of type characters. In some cases, the printer is also capable of printing a similar line of characters on a journal tape.

Such printers are compact, inexpensive and highly reliable. However, such printers are generally capable of printing only a single line of characters on each slip. This is of a disadvantage in cases where additional desirable data cannot be included in a single line of print.

SUMMARY OF THE INVENTION

It therefore becomes a principal object of the present invention to provide a slip printer of the above type which can utilize a serial printer for printing a plurality of lines of print on a slip or the like.

Another object of the invention is to provide a slip printer of the above type with an improved type of line spacing means.

Another object is to provide a slip printer of the above type which will print on slips of varying thicknesses.

A further object is to provide a slip printer of the above type which is simple, compact, inexpensive to manufacture and highly reliable.

BRIEF DESCRIPTION OF THE DRAWING

The manner in which the above and other objects of the invention are accomplished will be readily understood on reference to the following specification when read in conjunction with the accompanying drawing, wherein:

FIG. 1 is a perspective view of a slip printer embodying a preferred form of the present invention.

FIG. 2 is a sectional plan view, partly broken away, and taken substantially along line 2—2 of FIG. 3.

FIG. 3 is a sectional elevation view, partly broken away, and taken along line 3—3 of FIG. 2.

FIG. 4 is a sectional elevation view, partly broken away, and taken substantially along line 4—4 of FIG. 2.

DESCRIPTION OF THE PREFERRED EMBODIMENT

While this invention can be embodied in many different forms, there is shown in the drawings a preferred form but it should be understood that the present disclosure is to be considered only as an exemplification of the principals of the invention and is not intended to limit the same to the embodiment shown therein. The scope of the invention will be pointed out in the appended claims.

As shown in the drawing, the printer is housed in a casing 11. The latter has an opening 12 forming part of a vertical slot or chute 13 extending downwardly to the level of a floor plate 14. Spaced side plates 15 and 16 are suitably secured to the floor plate 14 for supporting parts of the printer.

Axially aligned guide rollers 22 and 23 are rotatably mounted on brackets 124 extending upwardly from the floor plate 14 to aid in guiding a slip, i.e. 21, of paper or the like into the chute and also act as a backup against which the slip is pressed by elastomeric feed rollers 24 and 25 during printing and vertical line space feeding of the slip, as will be described presently.

A serially operable inkjet print head 26 is provided to print a line of characters along a portion of the length of the inserted slip. Such head is of conventional construction and may obtained from the Hewlett Packard Company of Palo Alto, Calif., as part number HP51604A.

The print head has a plurality of vertically aligned minute inkjet nozzles indicated by dotted lines 27 (FIGS. 2 and 4) which can be individually controlled by a suitable data processing system (not shown) to impel minute globules of ink in patterns against the surface of the inserted slip to form readable characters. The inkjet nozzles 27 are vertically located in line with the points of engagement between the feed rollers 24, 25 and the slip 21.

The print head 26 is carried by a carriage 28 which is slidably mounted on a stationary rod 125 supported between the brackets 124. The print head and its carriage are movable along the rod 125 between the side plates 15 and 16 by a suitable stepper motor (not shown) under control of the data processing system to step the print head along a portion of the slip 21 during the printing operation.

Reference may be had to the aforesaid U.S. Pat. No. 5,080,513 for disclosure of a suitable data processing system and stepper motor controlled thereby and capable, with minor modifications of controlling the motor for the present print head.

Means are provided to incrementally advance the slip 21 vertically from its lowermost position wherein it rests on the floor plate 14, through any of a number of print line positions. For this purpose, a stepper motor 30 of conventional construction is mounted on the side plate 16 by clamp screws 31 which extend through arcuate slots 32 in ears 34 formed on the motor 30 and are threaded into the side plate 16. A drive gear 33 on the motor, which gear is concentric with the slots 32, meshes with gear 35 of a compound idler gear 134 rotatably supported at 37 by the side plate 16. The smaller gear 36 of the idler meshes with a gear 38 carried by a journal tape feed roll 40 rotatably mounted between the side plates 15 and 16. Feed roll 40 carries a pair of elastomeric feed tires 140 engagable with a journal tape 55. Gear 38, in turn, meshes with an idler 41 rotatably supported by the side plate 16. The latter idler meshes with a gear 42 carried on the right hand end (FIG. 2) of a shaft 43 extending across the printer. Shaft 43 carries at its ends the aforementioned feed rollers 24 and 25. Bearing hubs 44 and 45 on shaft 43 are rotatably and slidably mounted in respective arcuate slots, i.e. 46, formed in the side plates 15 and 16. The slots 46 extend concentric with the axis of gear 41.

The feed rollers 24 and 25 are normally held in retracted positions as shown in FIGS. 2, 3 and 4 to permit the slip 21 to be easily slid through the chute 13. For this purpose, a spring 47 is tensioned between a frame part 48 and one arm of a bell crank 50 pivotally supported at 51 on a frame part. Such bell crank arm is pivotally connected at 52 to the roller shaft 43 at a point midway between the ends of the latter. The other arm of the bell crank is pivotally connected to the armature 53 of a solenoid 54.

When the solenoid 54 is energized, the bell crank 50 is rocked counterclockwise thus forcing the feed rollers 24 and 25 into a light frictional engagement with the inserted slip 21. Due to the application of force by the bell crank 49 at a mid point on the shaft 43, equal pressure will be applied by both feed rollers 24 and 25 against the slip.

Energization of the stepper motor 30 to line space the slip 21 upwardly will cause its drive gear 33 to rotate clockwise, resulting in the entrained gear 41 rotating counterclockwise to drive the gear 42 and feed rollers 24 and 25 clockwise to step the slip upwardly from one print line position to another.

Since the gear 41 applies a leftwardly extending force (as seen in FIGS. 3 and 4) against a gear tooth on the lower parts of the gear 42, it will increase the engaging force of the feed rollers 24 and 25 against the slip 21 beyond that exerted by the spring 47. Thus, the gear 41 will tend to both rotate the feed rollers 24 and 25 and also move the gear 42 about gear 41 without affecting their meshing rotation. Also, if any resistance is encountered in feeding the form upwardly to a new print line position, a greater frictional engaging force will be transmitted by the feed rollers 24 and 25 against the slip. Accordingly, a relatively small and weak solenoid 54 need be used to initially drive the feed rollers 24 and 25 against the slip.

The stepper motor 30 may be controlled by the data processing system in an obvious manner to incrementally advance the slip from any one print line position to a next or to any other such print line position. Also, the locations of the print lines relative to the lower edges of the slip 21 may be precisely adjusted by loosening the clamp screws 31 to rotatably adjust the stepper motor 30 into different angular positions.

Provision is also made for printing on the journal tape 55. The latter is fed from a supply roll 56, between side plates 15 and 16 and around the journal feed roll 40 from whence it is guided upwardly behind a thin guide member 57 and past the printer head 26. A suitable pressure roller (not shown) may be provided to frictionally engage the tape 55 with the roll 40. Thus, when no slip 21 is presented in the chute 13, the printer will be effective to print the requisite number of print lines directly onto the journal tape 55.

It should be noted that the journal feed roll 40 and the slip feed rollers 24 and 25 are of equal diameters and the gears 38 and 42 are also of equal pitch diameters. Thus, the journal tape 55 will be advanced through line spacing amounts equal to the line spacings on the slip 21.

A photoelectric sensor 60 is provided to sense the position of the printer head carriage 28 and two additional sensors 61 and 62 are provided to sense the position of the inserted slip 21 and to control the microprocessor accordingly.

From the above it will be seen that I have provided an extremely simple, compact and inexpensive slip printer for printing any of a number of different lines of print lengthwise of a slip or the like. Further, the printer can be utilized to selectively print lines of data on a slip only or on a journal tape only or on both by printing one time with the slip inserted in the chute and at another time with the slip removed.

I claim:

1. A printer for slips or the like comprising means forming a vertical guideway into which a slip may be dropped, means forming a floor against which said slip may limit when dropped into said guideway, a pair of spaced freely rotatable guide rollers on one side of said guideway, a shaft on the side of said guideway opposite said guide rollers, a pair of spaced feed rollers on said shaft opposite respective ones of said guide rollers, said feed rollers having frictional drive surfaces thereon, a drive gear, means supporting said drive gear for rotation about an axis, a driven gear on said shaft meshing with said drive gear, said drive gear being, means for guiding said shaft about said axis of said drive gear, a printing device intermediate said guide rollers for printing a line of print on said slip substantially in line with the line of contact between said feed rollers and said slip, retainer means normally maintaining said shaft and said feed rollers away from said guide rollers, and means other than said drive gear for thereafter rotating said shaft in a direction to further engage said feed rollers with said slip and to line feed said slip past said printing device.

* * * * *